United States Patent [19]

Young

[11] 4,289,198

[45] Sep. 15, 1981

[54] HEAT EXCHANGER

[75] Inventor: Richard K. Young, Bartlesville, Okla.

[73] Assignee: Phillips Petroleum Company, Bartlesville, Okla.

[21] Appl. No.: 959,283

[22] Filed: Nov. 9, 1978

[51] Int. Cl.[3] ..... F28D 7/00

[52] U.S. Cl. ..... 165/159

[58] Field of Search ..... 165/159, 161

[56] References Cited

U.S. PATENT DOCUMENTS

| | | | |
|---|---|---|---|
| 1,894,760 | 1/1933 | Dodd | 165/161 X |
| 2,059,967 | 11/1936 | Leach | 165/161 X |
| 2,735,658 | 2/1956 | Cook . | |
| 2,805,049 | 9/1957 | Katholi | 165/159 |
| 3,351,131 | 11/1967 | Berthold | 165/159 |
| 3,964,146 | 6/1976 | Vestre . | |
| 3,967,677 | 7/1967 | Mohlman . | |

*Primary Examiner*—Donald F. Norton

[57] ABSTRACT

In a shell-tube heat exchanger which can be a single pass or multiple pass exchanger, a stream distributing means of baffle is provided to distribute a fluid entering and/or exiting the shell side of the exchanger so that at least a portion of the entering or exiting fluid is directed toward the adjacent tube sheet, comprising a flow deflecting means positioned transverse of the tubes and in between the tubes which are located between the centerline of a pass of the exchanger and the shell inlet and/or outlet, and in alignment with the longitudinal axis of the shell inlet and/or outlet.

7 Claims, 6 Drawing Figures

HEAT EXCHANGER

Figure 1:
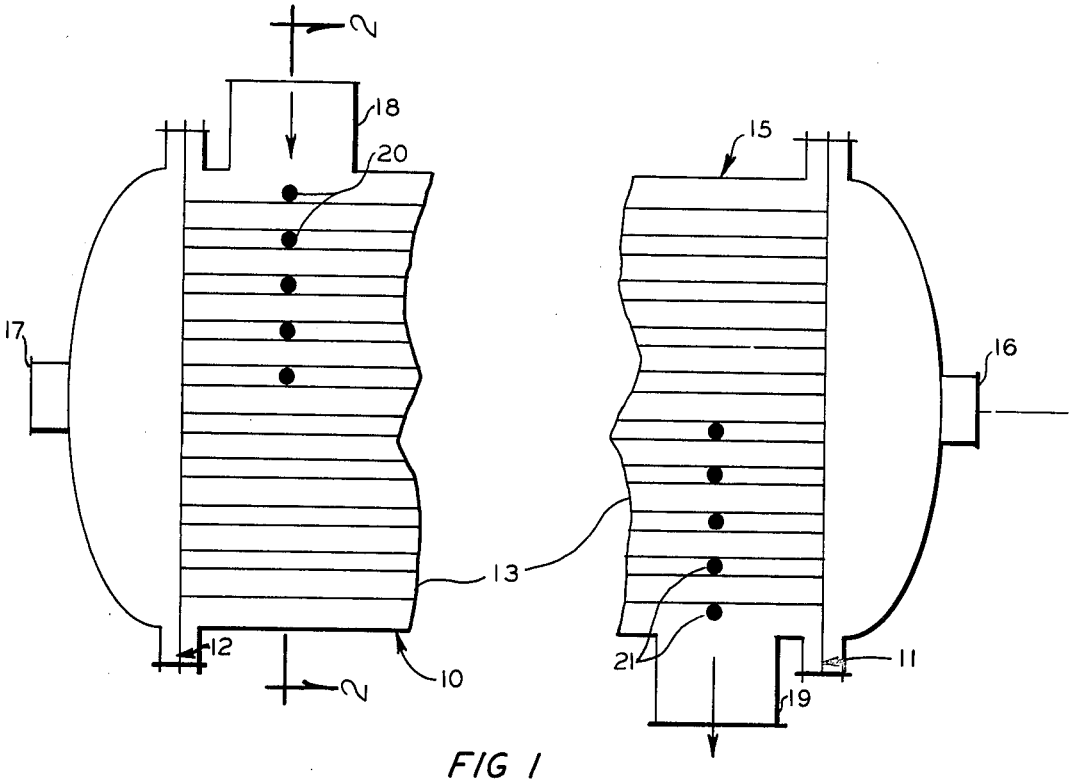

This invention relates to shell and tube heat exchangers. In accordance with another aspect, this invention relates to a distributing baffle so positioned as to distribute the fluid entering and/or leaving the shell side of a shell and tube heat exchanger. In accordance with a further aspect, this invention relates to a baffle to distribute the fluid entering and/or leaving the shell side of a single pass exchanger or more complex exchanger comprising flow detecting means located between the centerline of the exchanger and the shell inlet and/or outlet and in alignment with the shell inlet and/or shell outlet.

Heat transfer is an important part of any process. As is well known, an indirect transfer of heat from one medium to another is usually accomplished by the use of heat exchangers of which there are many types. For example, there are double pipe, shell and tube, plate heat exchangers and others. Indeed, the art of heat exchanger design is developed to a very high degree; however, there is still room for improvement in a number of areas, such as reducing pressure drop, increasing overall heat transfer coefficients, reducing fouling, improving tube support, improving fluid distribution, and the like. The present invention is concerned with providing a fluid distributing baffle on the shell side of a shell and tube heat exchanger that will cause good shell side fluid distribution, and, at the same time, provide tube support without creating substantial pressure drop.

Accordingly, an object of this invention is to provide improved shell and tube heat exchangers.

Another object of this invention is to provide shell and tube heat exchangers having improved fluid distribution on the shell side of the heat exchanger.

A further object of this invention is to provide a fluid distributing device for shell and tube heat exchangers.

Other objects, aspects, as well as the several advantages will be apparent to those skilled in the art upon reading the specification, drawings, and the appended claims.

In accordance with the invention, a shell and tube heat exchanger is provided with flow deflecting means positioned transverse of the tubes which are located between the centerline of a pass of the exchanger and the shell inlet and/or outlet and in substantial alignment with the shell inlet and/or outlet so that at least a portion of the entering or exiting fluid is directed toward the adjacent tube sheet.

In accordance with one embodiment of the invention, a distributing rod baffle means is provided for tube-in-shell heat exchangers comprising a set of flow deflecting or directing rods positioned in the spaces between adjacent tube rows of the tubes positioned between the longitudinal axis of the heat exchanger, or of a pass of the exchanger, and one of the shell inlet and shell outlet, and in alignment with the longitudinal axis of one of the shell inlet and shell outlet to provide improved shell side fluid distribution of the inlet and/or outlet and provide tube support without creating substantial pressure drop.

In accordance with another embodiment, the distributing rod baffles of the invention are positioned at both the shell inlet and the shell outlet of a single pass-tube-in-shell heat exchanger in vertical or longitudinal axial alignment with the shell inlet and shell outlet.

It has been found in rod-baffled shell and tube heat exchangers that it is possible for shell side fluid to partially by-pass tubes located beneath the inlet or outlet nozzle or between the nozzle longitudinal axis or centerline and the nearest or adjacent tube sheet. The fluid distributing or flow deflecting baffle of the invention is one having all gaps between tubes filled substantially perpendicular to the nozzle, preferably the nozzle centerline in the half of the bundle closest to the nozzle. The entering or exiting fluid is divided by the baffle with about half flowing between the baffle and the tube sheet to the lower half of the bundle, thus insuring good fluid distribution over the entire bundle cross-section.

Figure 2:
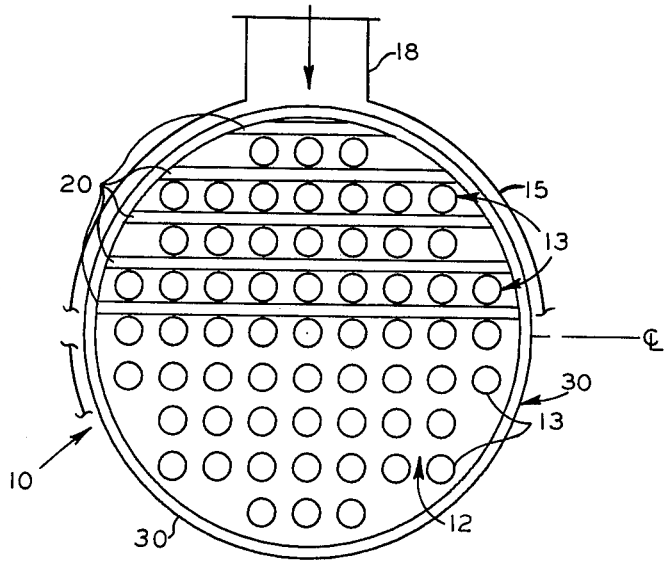
Figure 3:
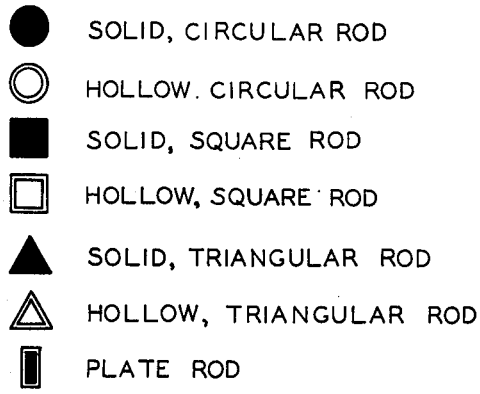
Figure 4:
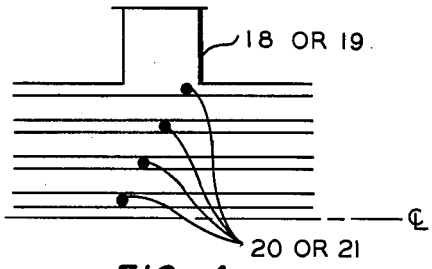
Figure 5:
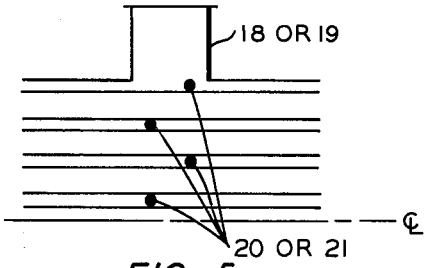
Figure 6:
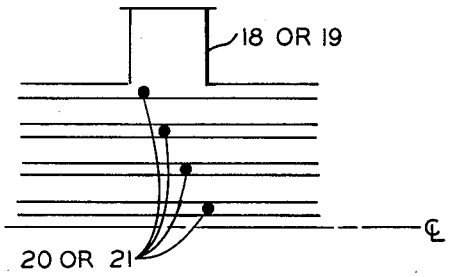

A better understanding of the invention will be obtained upon reference to the drawings in which:

FIG. 1 is a side view of a shell and tube heat exchanger having a distributing rod baffle at the shell inlet and shell outlet, FIG. 2 is a view taken along 2—2 of FIG. 1 showing the shell inlet, FIG. 3 shows various rods which can be used to make up the distributing rod baffle, as indicated on the drawing, and FIGS. 4, 5, and 6 illustrate the various arrangements of the rod baffle, illustrated with respect to the shell fluid inlet means.

Referring now to FIG. 1, a heat exchanger noted generally by reference numeral 10 has two tube sheets 11 and 12, tubes 13, which are in the form of a tube bundle, positioned inside shell 15. The tube side of exchanger 10 has an inlet nozzle 16 and an outlet nozzle 17 to permit a first fluid to pass over the inside surface of the tubes 13 and the shell side has an inlet nozzle 18 and an outlet nozzle 19 to permit a second fluid to pass over the outside surface of the tubes 13 and using countercurrent flow of the heat exchange mediums. The tubes 13 in heat exchanger 10 can be laid out in any desired pitch such as equilateral triangular pitch, square pitch, hexagonal pitch, or any other desired arrangement. Square pitch is illustrated.

In accordance with the invention, a rod baffle set 20 is positioned (as illustrated) below shell inlet nozzle 18 so as to cause good shell side fluid distribution of fluid entering the shell side. As can be seen from the drawing, the shell side inlet fluid will be divided where some of the fluid passes downwardly over the tube ends between baffle 20 and tube sheet 12 so that some of the fluid enters a lower portion of the bundle. The rods extend horizontally across the tube bundle between adjacent rows of tubes and extend across the shell extremities. The ends of the rods 20 can be fastened as by welding to the retaining ring means 30, as shown in FIG. 2.

Other means of fastening rods along the perimeter of the shell can be used such as disclosed in Ser. No. 715,704, now U.S. Pat. No. 4,136,736 Small, and Ser. No. 703,028, now U.S. Pat. No. 4,127,165, Small, both commonly assigned and U.S. Pat. No. 3,708,142 (Small); all three of these references and applications are incorporated herein by reference.

A distributing rod baffle is provided above shell outlet 19 and is designated with numeral 21. The fluid from the shell side exiting from the shell through nozzle 19 will be divided as fluid from an upper portion of the heat exchanger will flow downwardly between distributing baffle 21 and tube sheet 11 and be combined with fluid being removed from the lower portion of the heat exchanger.

Although the embodiment illustrated in FIG. 1 does not show baffles supporting the tubes between tube sheets 11 and 12, it is within the scope of the invention to provide suitable supports for the tubes. This can be accomplished using baffle plates extending from alternate sides of the shell interior across the tubes. It is also in the scope of the invention to use bar stock extending across the tube baffle in the spaces between columns of tubes and the spaces between rows of tubes as disclosed in U.S. Pat. No. 3,708,142.

Referring to FIG. 2, which is a cross-section of the heat exchanger 10 of FIG. 1 taken along cut 2—2, there are shown retaining ring 30 to which rod baffles 20 can be affixed, e.g., as by welding, shell inlet 18, heat exchanger shell 15, tube sheet 12, and the set of rod baffles 20 located between the centerline (as shown) of the exchanger and the shell inlet 18 (and in alignment with the longitudinal axis of inlet 18, as seen in FIG. 1). Rods 20 extend, preferably entirely, across the exchanger and are located in between rows of tubes 13, as shown. These rods 20 form a shell inlet fluid diverter, insuring that shell fluid is passed, in part, to the tubes 13 adjacent the surface of tube sheet 12.

FIG. 3 illustrates various rods 20 that can be used, including solid circular cross-section rod, hollow circular cross-section rod, solid square cross-section rod, hollow square cross-section rod, solid triangular cross-section rod, hollow triangular cross-section rod, and a plate rod.

FIGS. 4, 5, and 6 illustrate various other arrangements of the rods 20 between the shell fluid inlet and/or outlet and the centerline of a pass of a shell tube heat exchanger. In FIGS. 4 and 6, for example, the rod baffle is set at an angle so as to direct flow toward or away from an adjacent tube sheet depending whether it is positioned near an outlet or an inlet. FIG. 5 illustrates another variation where the rods in the rod baffle flow distributor are alternately staggered between the tubes, but the baffle is in alignment with the shell inlet and/or outlet.

In an embodiment of the invention, a set of tubes 20, making up a distributing baffle set, is positioned below shell inlet nozzle 18 to distribute shell heat exchange fluid being introduced into heat exchanger 10. Another set of tubes 21, making up a distributing baffle set, is located above shell outlet 19 to aid in distributing shell fluid exiting from heat exchanger 10. Rod baffle sets made up of rods 20 and of rods 21 are illustrated with suitable equipment including an outer ring 30 surrounding the tubes 13 in the tube bundle which rods can be welded or otherwise affixed to ring 30 to secure rods extending across and through the tube bundle.

For sake of simplicity, baffle means, including rod baffle means of U.S. Pat. No. 3,708,142 (Small), and those disclosed in U.S. applications Ser. Nos. 715,704 (Small) and 703,028 (Small) are not shown in the FIG. 1. Any conventional baffle means to cause nonlinear flow of shell fluid over the tubes 13 can be used.

It is appreciated by those skilled in the art that heat exchangers designed in accordance with the invention can be designed incorporating a variety of the configurations known in the art such as U-tubes or multiple-tube passes, floating head designs, etc. as disclosed and illustrated in the Chemical Engineer's Handbook, Perry, Fourth Edition, McGraw-Hill, 1963, § 11, pp. 2–4 and U.S. Pat. No. 2,919,903 (1960).

In an effort to more fully describe the invention the following example is provided.

EXAMPLE
FOR FIG. 1
(Calculated)

| | |
|---|---|
| Shell Fluid 18: | |
| Gallons/hour | 100 |
| Temperature, °F. | 85 |
| (Fluid is water) | |
| Shell Fluid 19: | |
| Gallons/hour | 100 |
| Temperature, °F. | 155 |
| (Fluid is water) | |
| Tube Fluid 16: | |
| Gallons/hour | 100 |
| Temperature, °F. | 180 |
| (Fluid is water) | |
| Tube Fluid 17: | |
| Gallons/hour | 100 |
| Temperature, °F. | 110 |
| (Fluid is water) | |
| Division of Fluids (Estimated) | |
| Fluid 18 passed toward tube sheet 12 by rod baffle comprised of rods 20; | |
| Volume percent of fluid 18 | 15 |
| Fluid 19 passed toward tube sheet 11 by rod baffle comprised of rods 21; | |
| Volume percent of fluid 19 | 15 |

It is estimated that about ten percent additional heat exchange is realized by use of the rod baffle inlet and outlet deflectors.

I claim:

1. A shell and tube heat exchanger comprising in combination:

a longitudinal shell, tube sheets at opposite ends of said shell, a plurality of tubes in a bundle of generally cylindrical form extending between said tube sheets, means to introduce fluid to said tubes and withdraw fluid from said tubes at the faces of said tube sheets, shell inlet means to introduce fluid to the interior of said shell external of said tubes, and shell outlet means to withdraw fluid therefrom, and a stream distributing means or baffle comprising a flow deflecting means positioned transverse of the tubes and filling substantially all of the space between adjacent rows of tubes in a direction perpendicular to the axis of the shell inlet and/or shell outlet which means are located between the centerline of a pass of the exchanger and the shell inlet and/or shell outlet and in substantial alignment with the longitudinal axis of the shell inlet and/or shell outlet and the space between rows of tubes beyond said centerline of said pass of the exchanger, and in substantial alignment with said flow deflecting means, being substantially devoid of flow directing means to provide improved shell side fluid distribution of the inlet and/or outlet by distributing a fluid entering and/or exiting the shell side of the exchanger so that at least a portion of the entering or exiting fluid is directed toward the adjacent tube sheet.

2. An apparatus according to claim 1 wherein said distributing means is positioned at both the shell inlet and shell outlet.

3. An apparatus according to claim 2 wherein said distributing means is in vertical coaxial alignment with said shell inlet and said shell outlet.

4. A shell and tube heat exchanger according to claim 1 wherein the tubes are radially supported with at least one rod baffle set between the shell inlet and shell outlet.

5. An apparatus according to claim 1 wherein the tubes are laid out on a square pitch.

6. An apparatus according to claim 1 wherein the tubes are laid out on a triangular pitch.

7. An apparatus according to claim 1 wherein the tubes are laid out on a hexagonal pitch.

* * * * *